US005269026A

United States Patent [19]

McManus

[11] Patent Number: 5,269,026

[45] Date of Patent: Dec. 14, 1993

[54] ADJUSTABLE CAP WITH SAFETY LINER

[76] Inventor: Eugene E. McManus, 608 N. Park St., Watertown, S. Dak. 57201

[21] Appl. No.: 901,153

[22] Filed: Jun. 19, 1992

[51] Int. Cl.[5] ..... A42B 3/12

[52] U.S. Cl. ..... 2/411; 2/63; 2/414; 2/418; 2/195.2

[58] Field of Search ..... 2/63, 171.1, 181, 181.4, 2/181.6, 181.2, 182.2, 183, 185 R, 190, 196, 197, 199, 209.1, 410, 411, 412, 414, 417, 418

[56] References Cited

U.S. PATENT DOCUMENTS

| | | | |
|---|---|---|---|
| 1,077,833 | 11/1913 | Houghton | 2/63 |
| 1,531,734 | 3/1925 | Carpenter | 2/63 |
| 2,478,550 | 8/1949 | Smith | 2/63 |
| 3,268,911 | 8/1966 | Cox | 2/181.4 |
| 3,457,563 | 7/1969 | Marchello | 2/414 |
| 3,551,911 | 1/1971 | Holden | 2/411 |
| 3,829,900 | 8/1974 | Marangoni | 2/414 |
| 3,877,076 | 4/1975 | Summers | 2/414 |
| 3,992,721 | 11/1976 | Morton | 2/414 |
| 4,020,507 | 5/1977 | Morton | 2/412 |
| 4,100,320 | 7/1978 | Chisum | 2/411 |
| 4,432,099 | 2/1984 | Grick | 2/414 |
| 4,949,404 | 8/1990 | Fekete | 2/190 |
| 5,022,095 | 6/1991 | Fleury | 2/190 |

FOREIGN PATENT DOCUMENTS

| | | | |
|---|---|---|---|
| 183971 | 6/1986 | European Pat. Off. | 2/411 |
| 2496422 | 6/1982 | France | 2/181 |
| 322226 | 7/1957 | Switzerland | 2/63 |
| 353685 | 7/1931 | United Kingdom | 2/63 |
| 2202729 | 10/1988 | United Kingdom | 2/411 |

*Primary Examiner*—Clifford D. Crowder
*Assistant Examiner*—Diana L. Biefeld
*Attorney, Agent, or Firm*—Dickinson, Wright, Moon, Van Dusen & Freeman

[57] ABSTRACT

A hat of the type having an adjustable headband is provided with a safety liner which includes a lower edge received in the headband. The safety liner has adjustment means for allowing the length of the lower edge to be reduced in response to a circumferentially applied force of the headband. The safety liner includes cut-out sections and is designed to only partially encircle the head of a wearer. A large cutout is provided for location at the rear of the head of a wearer.

7 Claims, 2 Drawing Sheets

FIG. 1
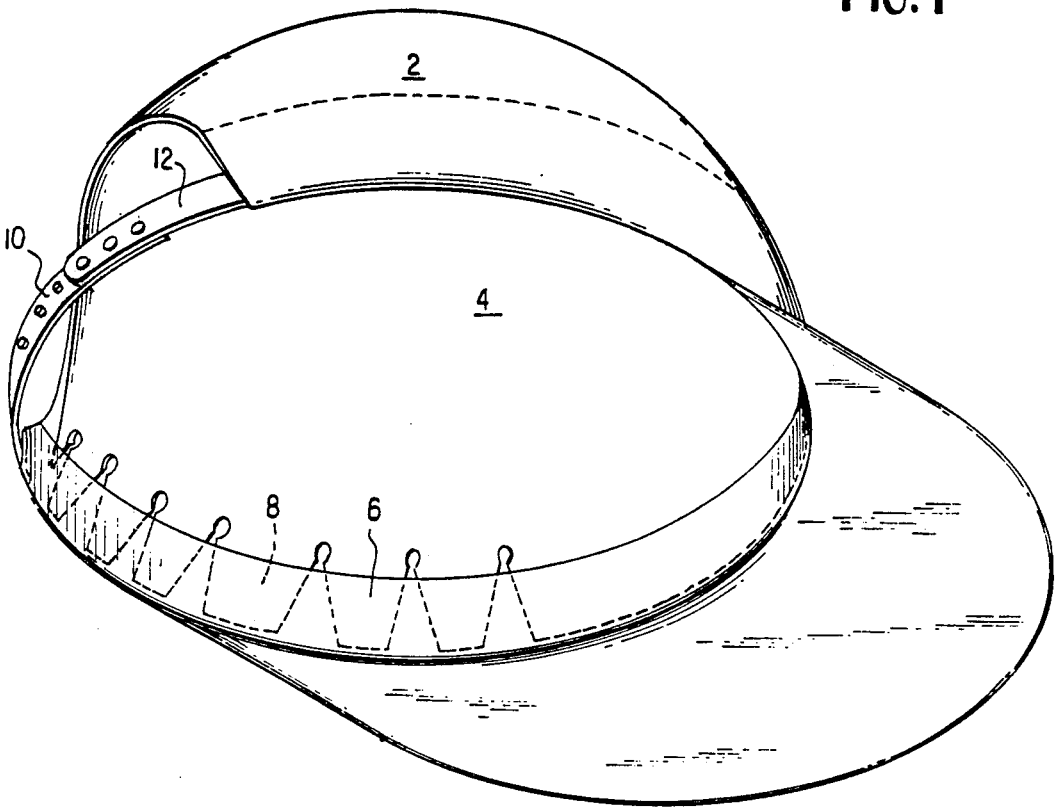
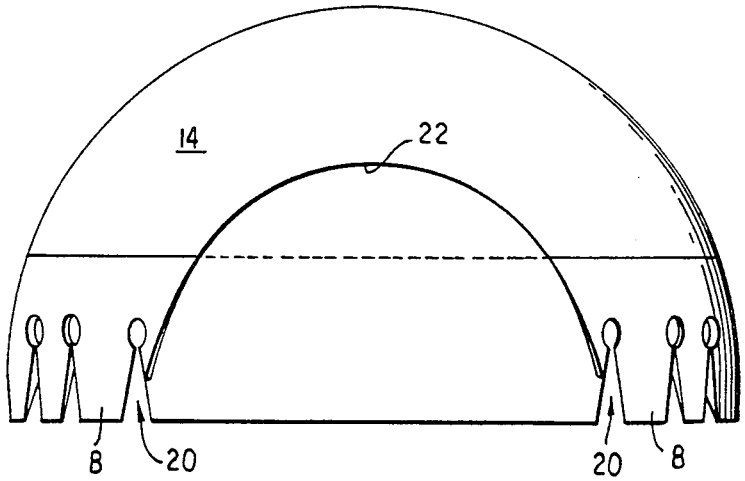
FIG. 2

FIG. 3
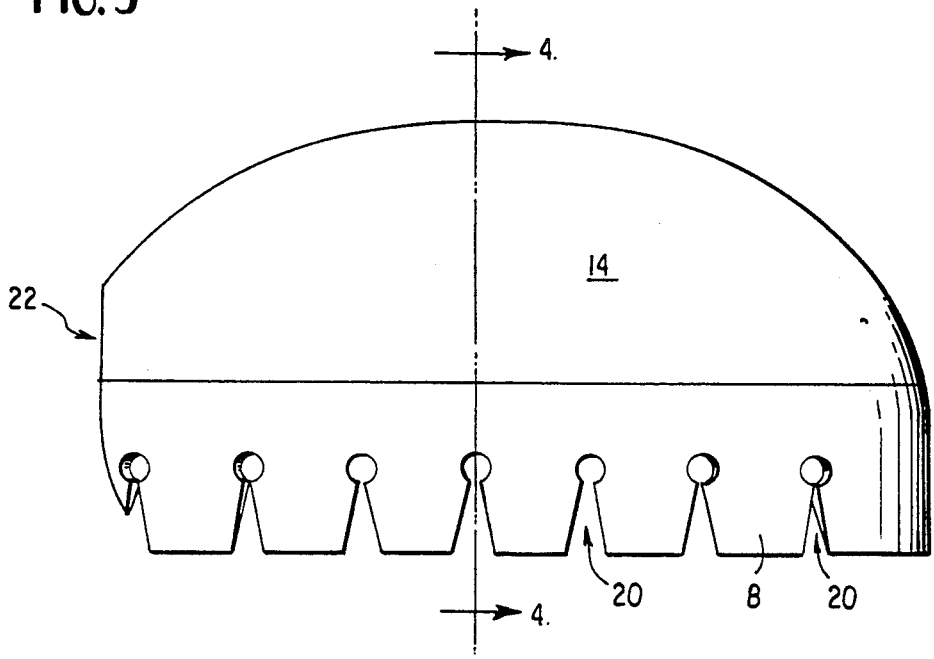
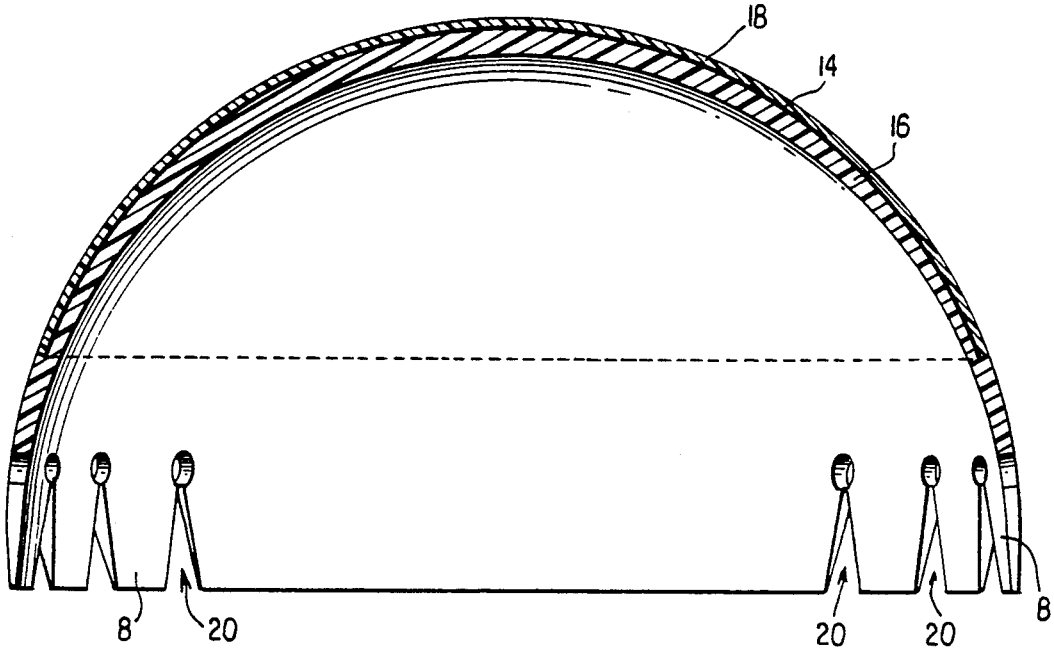
FIG. 4

ADJUSTABLE CAP WITH SAFETY LINER

TECHNICAL FIELD

This invention relates to the art of hats or caps. In particular, the invention relates to a hat having an adjustable headband and an adjustable safety liner.

BACKGROUND

It is known to provide a hat, such as a decorative hat that is part of a uniform, with a liner which provides protection to the head of a wearer. For example, U.S. Pat. No. 3,457,563 (Marchello) shows the combination of a hat with a safety liner. While the safety liner of the Marchello patent is designed to accommodate heads of various shapes, the shell must be formed in various sizes to accommodate heads of different sizes. That liner includes a hard outer shell and a foam liner. The foam liner tapers toward its bottom edge, and the bottom edge extends slightly below the bottom edge of the hard outer shell. This configuration increases skirt flexibility to allow the foam liner to conform to various head configurations.

Other protective head gear structures are shown in U.S. Pat. Nos. 3,551,911 (Holden); 4,100,320 (Chisum): and 4,020,507 (Morton).

SUMMARY OF THE INVENTION

None of the prior structures is truly adjustable to a wide variety of sizes of heads. For example, the safety liner of the Marchello patent adjusts to the shape of various heads but is not adjustable to the size of the head.

In accordance with the invention, a safety liner is provided which is capable of adjustment to a wide variety of sizes of heads. This liner is preferably combined with a known type of cap which provides an adjustable headband for engaging heads of various sizes. The adjustable headband cooperates with an adjustable lower edge of the safety liner to adjust the size of the liner, whereby the combination of the cap and liner may easily be fitted to any of a wide range of head sizes.

The safety liner of the invention preferably comprises an outer shell of semi-rigid plastic and an inner liner of flexible plastic. The inner liner may be of rubber but is preferably of foam material. The outer shell may adjust slightly to the size of a head, but the lower edge of the inner liner provides the majority of the adjustment. This lower edge extends well below the lower periphery of the outer shell and includes cutouts to allow the size of the inner liner to vary greatly to provide adjustability for fitting a wide range of heads. The thickness of the outer shell may decrease from the crown to the edge of the outer shell to provide additional flexibility.

BRIEF DESCRIPTION OF THE DRAWINGS

FIG. 1 is a bottom perspective of a safety liner in accordance with the invention combined with a known cap.

FIG. 2 is a rear view of the safety liner of the invention.

FIG. 3 is a side view of the safety liner of the invention.

FIG. 4 is a cross section taken along line 4—4 of FIG. 3.

DETAILED DESCRIPTION OF THE PREFERRED EMBODIMENT

Referring to FIG. 1, a preferred combination of the invention includes a cap 2 and a safety liner 4 held within the cap. The cap provides a sweatband 6 which engages and covers the lower edge 8 of an inner liner as will be explained in detail below. The cap also includes an adjustable head strap, the rear portion of which comprises two overlapping parts 10 and 12. The overlapping parts are capable of being secured together at a variety of locations to adjust the size of the cap to fit any of a wide variety of head sizes. Other types of adjustment mechanisms are known in the art, and these are within the scope of the present invention.

FIGS. 2, 3, and 4 illustrate the preferred embodiment of the safety liner per se. The safety liner preferably comprises an outer shell 14 of semi-rigid plastic, such as that used for a known batter's helmet, that is capable of protecting the head from a blow. The thickness of the outer shell may be uniform, as shown, or may taper from the crown to its peripheral edge. The outer shell is secured to an inner liner 16 by any of a variety of means, such as cement as shown at 18.

The inner liner 16 is preferably of foam and is flexible enough that the lower edge can be adjusted to the size of a particular head by varying the length of the headband, for example, by adjusting the degree of overlap of the ends 10 and 12. To make the lower edge 8 more flexible, the lower edge is preferably tapered and provided with a plurality of cutouts 20. The cutouts 20 may be arranged completely around the lower edge or may be placed only on the sides of the safety liner, as illustrated in the figures.

The lower edge of the inner liner does not completely encircle the head. Preferably, the safety liner includes a large cutout 22 at the rear of the safety liner. Cutout 22 extends from the inner liner into the outer shell and provides increased flexibility of the outer shell and the inner liner to increase the capability for adjustment of the size of the safety liner. The cutout 22 does not extend so far as to reduce significantly the protection afforded by the safety liner, however. For example, the top of the cutout 22 may be 2 to 2½ inches above the bottom border of the lower edge.

While the safety liner of the invention has been shown as comprising two distinct materials, it is within the contemplation of the invention that it be formed of a single material or of a composite material.

It will be appreciated that a unique safety cap has been described. Modifications within the scope of the appended claims will be apparent to those of skill in the art.

We claim:

1. In combination, a hat having an adjustable headband and a safety liner, said safety liner comprising protective means for fitting over the head of a wearer and under said hat and protecting said head of a wearer from a blow, said protective means including a lower edge received in a lower edge of said headband and having adjustment means for allowing the length of said lower edge of said headband to be reduced in response to a circumferential force applied by adjustment of said headband.

2. A combination according to claim 1 wherein said adjustment means comprises cut-out sections.

3. A combination according to claim 2 wherein said lower edge of said protective means is designed to only partially encircle the head of a wearer.

4. A combination according to claim 1 wherein said protective means comprises an outer protective member and an inner member for at least partially engaging the head of a wearer, said inner member being secured to said outer member.

5. A combination according to claim 4 wherein a cutout is formed in said outer and inner members for location at the rear of the head of a wearer.

6. A continuation according to claim 4 wherein the thickness of said outer protective member decreases from a top portion of said outer member to an edge portion.

7. A continuation according to claim 6 wherein said outer protective member is made of semi-rigid plastic.

* * * * *